United States Patent [19]

Wehner, deceased

[11] 4,113,221

[45] Sep. 12, 1978

[54] LOCKING DEVICE

[75] Inventor: Norvin J. Wehner, deceased, late of Kansas City, Mo., by Virginia L. Wehner, surviving spouse

[73] Assignee: Cramer Industries, Inc., Kansas City, Kans.

[21] Appl. No.: 801,055

[22] Filed: May 27, 1977

[51] Int. Cl.[2] ..... F16M 11/04

[52] U.S. Cl. ..... 248/408; 292/61; 403/324; 403/328

[58] Field of Search ..... 248/407, 408, 409, 423, 248/188.5, 354 P; 292/57-62; 297/338, 345, 437; 403/108, 109, 322, 324, 325, 328; 108/146

[56] References Cited

U.S. PATENT DOCUMENTS

| | | | |
|---|---|---|---|
| 701,238 | 5/1902 | Williams | 292/61 |
| 814,439 | 3/1906 | Fraser | 292/58 |
| 1,335,884 | 4/1920 | Elton | 248/407 |
| 1,394,513 | 10/1921 | Albonesi | 292/60 |
| 1,491,685 | 4/1924 | Eicher et al. | 248/408 |
| 1,610,069 | 12/1926 | Weber | 248/408 X |
| 2,308,358 | 1/1943 | Cramer | 297/437 |
| 2,572,072 | 10/1951 | Stoner | 297/329 |
| 2,635,317 | 4/1953 | Harley | 292/60 X |
| 3,770,236 | 11/1973 | Marsh et al. | 248/408 |

FOREIGN PATENT DOCUMENTS

| | | | |
|---|---|---|---|
| 703,625 | 2/1931 | France | 403/109 |
| 800,118 | 4/1936 | France | 297/345 |
| 1,334,083 | 6/1963 | France | 403/108 |
| 2,390 of | 1913 | United Kingdom | 292/61 |
| 8,043 of | 1893 | United Kingdom | 292/62 |
| 21,868 of | 1913 | United Kingdom | 403/322 |

*Primary Examiner*—Lawrence J. Staab
*Attorney, Agent, or Firm*—Fishburn, Gold & Litman

[57] ABSTRACT

A locking device having portions engageable with a movable member for retaining same in a selected position relative to a stationary support member. The locking device includes a body member mounted on the stationary member and a plunger within the body member and having one end portion thereof movable into and out of a selected one of a plurality of sockets in the movable member in response to movement of a cam follower on the plunger along a cam surface on the body member. Movement of the cam follower is effected by a handle in engagement with the cam follower and cooperating portions on the cam and lock structure retains the plunger at an end of its travel until relative movement is positively effected.

3 Claims, 6 Drawing Figures

LOCKING DEVICE

The present invention relates to locking devices and more particularly to a locking device having portions engageable with a movable member for retaining same in a selected position relative to a stationary support member.

Chair and stool structures having vertical seat height adjustment usually have a locking plunger engaging in one of a plurality of recesses in a seat post to hold same in selected height position.

The principal objects of the present invention are: to provide a lock structure that eliminates the above noted disadvantages of heretofore known lever cam seat lock structures; to provide a locking device having portions engageable with a movable member for retaining same in a selected position relative to a stationary support member; to provide such a locking device characterized by absence of exposed portions subject to accidental engagement effecting release of the locking device and undesired movement of a movable member; to provide such a locking device characterized by the absence of exposed portions which could cause injury to a person or damage to clothing; to provide such a locking device wherein operative parts are enclosed within a body member and include a plunger having a cam follower thereon which is movable along a cam surface in response to turning of a handle sleeved on a body member enclosing the plunger therein; to provide such a locking device which is particularly useful on a chair or stool structure having a vertically adjustable seat portion supported on a post depending therefrom and received within a tubular support standard or base and to provide such a locking device which is economical to manufacture, durable in construction, positive in operation and particularly well adapted for the proposed use.

Other objects and advantages of this invention will become apparent from the following description taken in connection with the accompanying drawings wherein are set forth by way of illustration and example certain embodiments of this invention.

The drawings constitute a part of the specification and include an exemplary embodiment of the present invention and illustrate various objects and features of the locking device.

Figure 1:
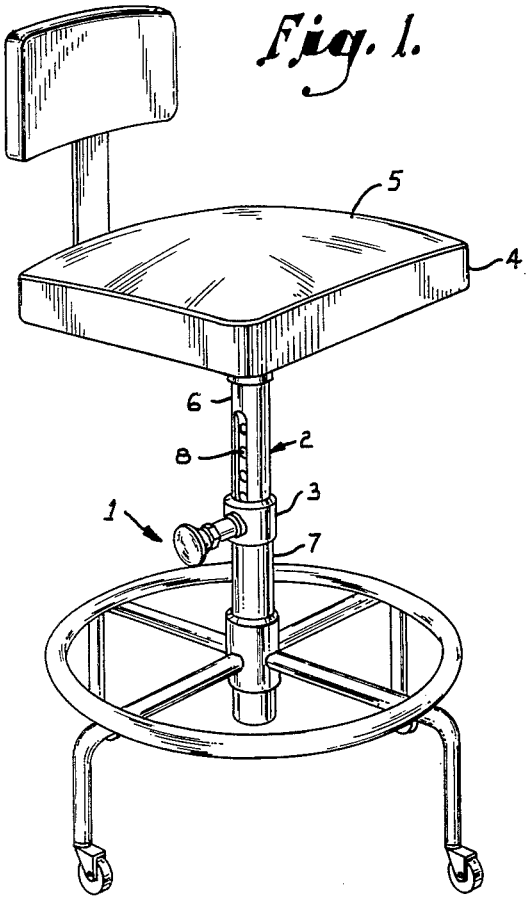
FIG. 1 is a perspective view of a chair structure having mounted thereon a locking device embodying features of the present invention.
Figure 2:
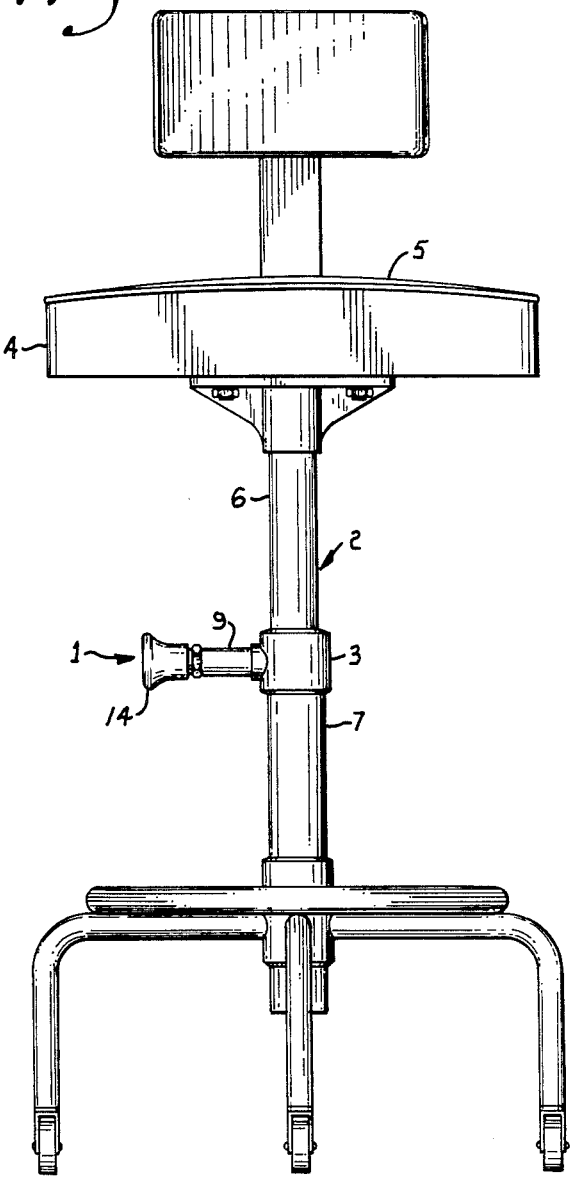
FIG. 2 is an enlarged side elevational view of the locking device mounted on the chair structure.
Figure 3:
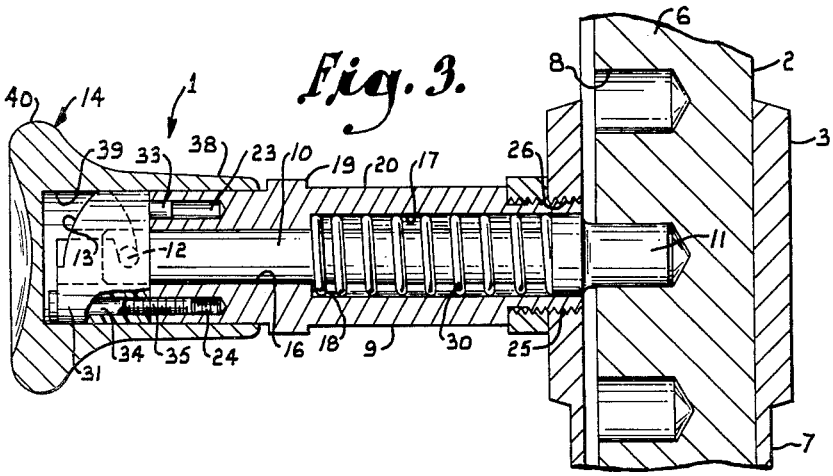
FIG. 3 is an enlarged longitudinal sectional view showing a plunger in an extended position.
Figure 4:
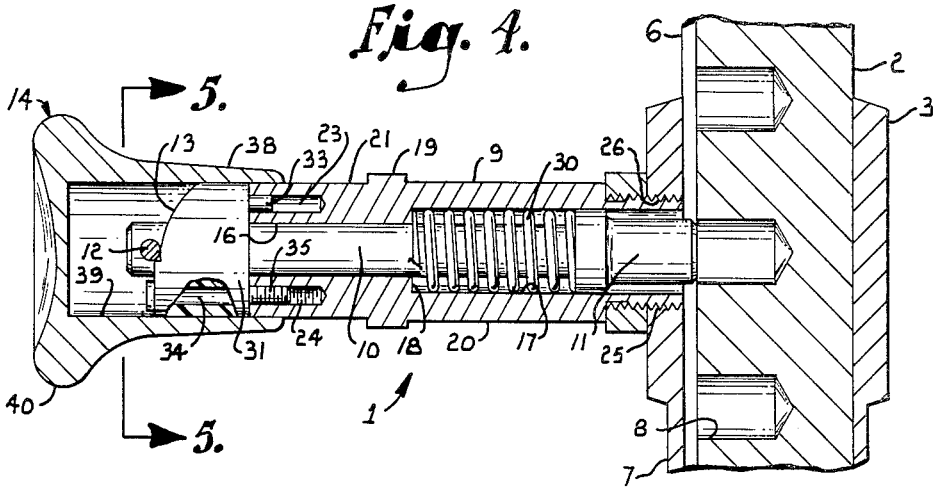
FIG. 4 is an enlarged longitudinal sectional view showing the plunger in a retracted position.
Figure 5:
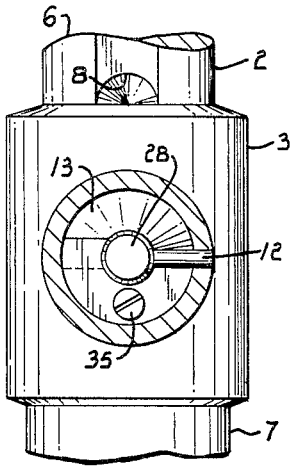
FIG. 5 is an enlarged transverse sectional view showing a cam surface and a cam follower in engagement therewith.
Figure 6:
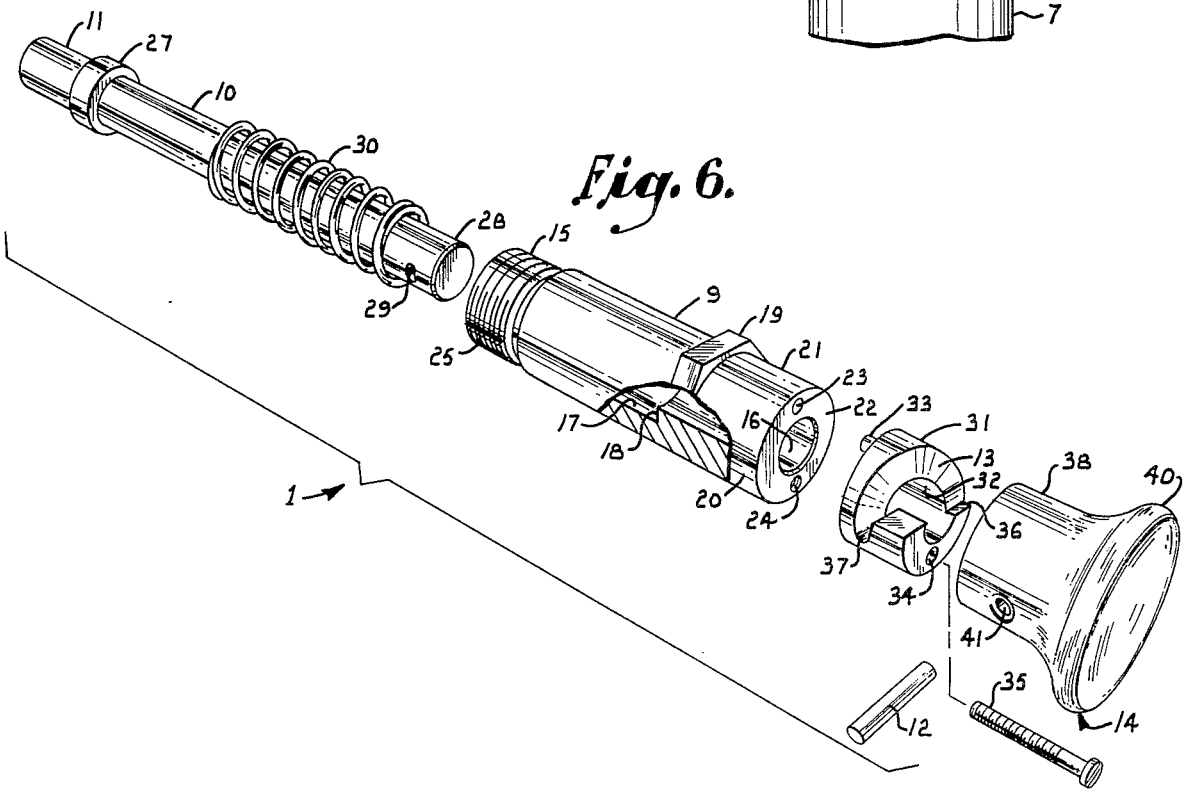
FIG. 6 is an enlarged exploded perspective view of the components of the locking device.

As required, detailed embodiments of the present invention are disclosed herein. However, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring more in detail to the drawings:

In the disclosed embodiment of the present invention the reference numeral 1 designates generally a locking device having portions engageable with a movable member 2 for retaining same in a selected position relative to a stationary support member 3. The locking device 1 is particularly useful on a chair or stool structure 4 having a vertically adjustable seat portion 5 supported on a post 6 depending therefrom and received within a tubular support standard 7. The locking device 1 is constructed so that accidental engagement with the exterior of the device 1 will not cause a plunger to move out of a respective socket 8 in the post 6 and remove support for the seat portion 5.

The locking device 1 includes a body member 9 mounted on the stationary support member 3 and a plunger 10 within the body member 9 and having one end portion 11 thereof movable into and out of a selected one of a plurality of spaced sockets 8 in the movable member 2 in response to movement of a cam follower 12 on the plunger 10 along a cam surface 13 on the body member 9. In the structure illustrated, the movement of the cam follower 12 is effected by turning a handle 14 in engagement with the cam follower 12.

The body member 9 is illustrated as an elongated member having one end portion 15 thereof capable of being mounted on a stationary support member 3, such as the tubular support standard 7, and extending substantially normal or perpendicular thereto. The body member 9 has a bore 16 extending longitudinally therethrough. The body member 9 includes a counter bore 17 extending from the one end portion 15 of the body member 9 thereby defining an interior shoulder 18 within the body member 9 for a purpose later described.

The body member 9 includes an exterior shoulder 19 defined by an abutment portion position intermediate the ends of the body member 9 and extending outwardly from an exterior surface 20 of the body member 9. The exterior surface 20 of the other end portion 21 of the body member 9 is generally cylindrical, for a purpose later described. The other end 22 of the body member 9 has two diametrically opposed longitudinally extending recesses 23 and 24 also for a purpose later described.

The body member 9 may be mounted on the stationary support member 3 or tubular support standard 7 in any suitable manner. In the illustrated embodiment, the one end portion 15 of the body member 9 is of a reduced size and is threaded, as at 25, to be received in a suitable threaded aperture or recess 26 in the support member 3.

The plunger 10 is an elongated generally cylindrical rod positioned within the bore 16 in the body member 9 and having one end portion 11 thereof movable into and out of a selected one of a plurality of sockets 8 in the movable member 2, such as a post 6 depending from a seat portion 5 of a chair or stool structure 4.

The plunger 10 includes an abutment portion 27 positioned intermediate the opposite ends thereof and extending outwardly from an exterior surface of the plunger 10. The abutment portion 27 on the plunger 10 has an exterior surface slidably received within the counter bore 17 within the body member 9. The abutment portion 27 defines a shoulder on the plunger 10 and the shoulder is positioned in spaced relation with the shoulder 18 within the body member 9.

The plunger 10 has a cam follower 12 in the form of a pin on the other end portion 28 and extending radially outwardly thereof. In the illustrated embodiment, the other end portion 28 of the plunger 10 includes an aperture 29 extending transversely through the plunger 10. The aperture 29 has an axis intersecting and substantially perpendicular to the longitudinal axis of the plunger 10.

The locking device 1 includes resilient means engaging the body member 9 and the plunger 10 for urging the one end portion 11 of the plunger 10 outwardly beyond the one end portion 15 of the body member 9 and into a selected one of the sockets 8 in the movable member 2. The resilient means also maintains the cam follower 12 in engagement with the cam surface 13.

The resilient means is illustrated as a coil or helical spring 30 sleeved on the plunger 10 and positioned between the other end portion 28 and the shoulder 27 on the plunger 10. The coil spring 30 is in engagement with and extends between the interior shoulder 18 within the body member 9 and the shoulder 27 on the plunger 10.

The locking device 1 includes means defining a cam surface 13 on the other end portion 21 of the body member 9. In the illustrated embodiment, the means defining the cam surface 13 includes a head 31 having a bore 32 extending axially therethrough. The head 31 has the cam surface 13 on one end thereof. The bore 32 through the head 31 is coaxial with the bore 16 and counter bore 17 through the body member 9 so that the plunger 10 may extend therethrough.

The head 31 is suitably mounted on the other end 22 of the body member 9. In the illustrated embodiment, the head 31 has a lug 33 extending from the other end of the head 31 and received in one of the recesses in the other end 22 of the body member 9, for example recess 23. The head 31 has a passage 34 therethrough which aligns with the other recess 24 in the other end 22 of the body member 9. A suitable fastening device such as a screw 35 extends through the passage 34 and into the other recess 24 and is adapted to secure the head 31 to the other end 22 of the body member 9.

The cam surface 13 is illustrated as a spiral or helix surrounding the bore 32 through the head 31. The cam surface 13 extends between a shoulder 36 adjacent the one end of the head 31 and a notch or pocket 37 adapted to receive the cam follower 12 or pin therein. It has been found that a slope in the nature of approximately 20° provides sufficient travel for the plunger 10.

The locking device 1 includes the handle 14 which engages the cam follower 12 and defines means for moving the plunger 10 relative to the body member 9. The handle 14 is movable relative to the body member 9.

The illustrated handle 14 includes a body portion 38 having a generally cylindrical recess 39 therein to receive the generally cylindrical other end portion 21 of the body member 9 whereby the handle 14 is rotatable on said body member 9 and is movable longitudinally thereof toward and away from the exterior shoulder 19 defined by the abutment portion on the exterior surface 20 of the body member 9. The handle 14 has the body portion 38 thereof sleeved on the other end portion 21 of the body member 9 and thereby surrounds the cam surface 13 on the head 31. The handle 14 includes an enlarged portion 40 on the free end thereof, the enlarged portion 40 is adapted to be grasped and manually turned or rotated relative to the body member 9. The body portion 38 of the handle 14 has an aperture 41 through the side wall defining same for receiving the cam follower 12 therein.

The cam follower or pin 12 defines means on the other end portion 28 of the plunger 10 extending radially across and engaging the helical cam surface 13 for moving along the cam surface 13. The illustrated cam follower 12 is a pin extending through the aperture 41 in the handle body portion 38 and through the aperture 29 in the plunger other end portion 28 so that a portion of the cam follower 12 extends radially outwardly from the plunger 10 and engages the handle 14.

In using a locking device constructed as illustrated and described, the body member 9 is mounted on the tubular support standard 7 or stationary support member 3, the handle 14 is turned to move the cam follower 12 toward the body member other end 22, thereby moving the one end portion 11 of the plunger 10 beyond the one end portion 15 of the body member 9 and into a selected one of a plurality of the sockets 8 in the movable member 2, such as a post 6 depending from the seat portion 5 of a chair or stool structure 4. The cam follower 12 is preferably moved into the notch or pocket 37 adjacent the one end 22 of the body member 9, said cam follower being in the notch 37 preventing the plunger 10 from being pulled straight outwardly. When it is desired to move the movable member 2 relative to the stationary support member 3, the handle 14 must be turned to move the cam follower 12 away from the other end 22 of the body member 9 thereby moving the one end portion 11 of the plunger 10 into the counter bore 17 within the body member 9. The movable member 2 is adjusted to the desired position and the handle 14 is turned to return the cam follower 12 to the notch or pocket 37 thereby moving the plunger one end portion 11 into a selected one of the plurality of sockets 8 in the movable member 2.

It is to be understood that while I have illustrated and described one form of my invention, it is not to be limited to the specific form or arrangement of parts herein described and shown.

I claim:

1. In a chair structure having a vertically adjustable seat supported on a post depending therefrom and slidably received in a bore of a support standard, a locking device therefor comprising:

(a) a body member having one end portion thereof mounted on a stationary support standard, said body member having a bore extending longitudinally therethrough and communicating with a mounting bore in said support standard;

(b) an elongated plunger slidably positioned within the bore in said body member and having one end portion thereof movable into a selected one of a plurality of sockets in a post depending from a seat portion of a chair structure and slidable in said support standard bore;

(c) resilient means mutually engaging said body member and said plunger for urging the one end portion of said plunger outwardly beyond the one end portion of said body member and into a selected one of the sockets in said post;

(d) means defining a helical cam surface on said body member and inclined longitudinally between a shoulder adjacent the other end portion thereof toward said one end portion and terminating in a pocket spaced from said other end portion, said body member pocket defined by body member portions extending over the adjacent cam surface in spaced relation thereto;

(e) a cam follower pin connected to the other end portion of said plunger and extending radially outwardly thereof, said pin being movably engaged with said cam surface and receivable into said pocket in response to rotation of said plunger and said resilient means moving said follower pin down said helical incline to extend said one end portion of the plunger into a selected socket, said pin being removable from said pocket in response to rotation of said plunger and movement up said inclined cam surface compressing said resilient means and retracting said one end portion of the plunger from said socket; and (f) a handle sleeved over said other end portion of said body member and enclosing said helical cam surface and connected to said plunger by said cam follower pin, said handle being helically movable relative to said body member for moving said follower pin along said cam surface and into said pocket and extending said plunger longitudinally through said body member and into a selected one socket in said post.

2. In a chair structure as set forth in claim 1 wherein:

(a) said other end portion of the body member comprises a head having a bore extending therethrough and coaxial with said bore extending through said body member and said means defining said cam surface is on one end thereof; and (b) the other end portion of said plunger extends through said bore in said head and includes an aperture extending transversely through said plunger;

(c) said cam follower pin extends through the body portion of said handle and through said aperture in said plunger.

3. A locking device as set forth in claim 1 wherein:

(a) said plunger includes an abutment portion having a shoulder positioned intermediate the ends thereof and extending outwardly from an exterior surface of said plunger;

(b) said body member includes a counter bore for receiving therein said abutment portion shoulder of said plunger and extending from the one end portion of said body member thereby defining an interior shoulder within said body member; and (c) said resilient means comprises a coil spring sleeved on said plunger and in engagement with and extending between said interior shoulder within said body member and said abutment portion shoulder on said plunger.

* * * * *